US006032509A

United States Patent [19]

Nagakura

[11] Patent Number: 6,032,509

[45] Date of Patent: Mar. 7, 2000

[54] PRESS BRAKE

[75] Inventor: Seiju Nagakura, Aichi, Japan

[73] Assignee: Toyokoki Co., Ltd., Aichi, Japan

[21] Appl. No.: 09/251,523

[22] Filed: Feb. 17, 1999

[30] Foreign Application Priority Data

Aug. 31, 1998 [JP] Japan ..... 10-245129

[51] Int. Cl.[7] ..... B21D 5/02; B30B 15/02; B21J 13/03

[52] U.S. Cl. ..... 72/389.5; 72/389.4

[58] Field of Search ..... 72/389.4, 389.5

[56] References Cited

U.S. PATENT DOCUMENTS

| | | | |
|---|---|---|---|
| 3,965,721 | 6/1976 | Roch | 72/389.5 |
| 4,354,374 | 10/1982 | Deguchi | 72/389.5 |
| 5,009,098 | 4/1991 | Van Mersteijn | 72/389.5 |
| 5,103,665 | 4/1992 | Van Merksteijn | 72/389.5 |

FOREIGN PATENT DOCUMENTS

| | | | |
|---|---|---|---|
| 2316953 | 10/1973 | Germany | 72/389.5 |
| 60-244425 | 12/1985 | Japan | 72/389.5 |
| 2-55622 | 2/1990 | Japan | 72/389.5 |

*Primary Examiner*—David Jones
*Attorney, Agent, or Firm*—Jordan and Hamburg LLP

[57] ABSTRACT

A press brake comprising a bed for supporting a lower mold on the upper surface thereof, a ram for supporting an upper mold in opposition to said lower mold a driver for causing either the ram or the bed to move for bending a workpiece between the upper and lower molds, and a distance adjusting device for adjusting the distance between the upper and lower molds via operation of a wedging unit and a pair of reciprocating units. The wedging unit is disposed either between the ram and the upper mold or between the bed and lower mold, and comprises a pair of movable wedges vertically disposed and a stationary wedge disposed between the movable wedges in contact with the movable wedges. Each of the contacting surfaces of the wedges is formed by a plurality of inclined planes having different angles of inclination. The reciprocating units are connected to the movable wedges to move the movable wedges along the length of the molds. By shifting the movable wedges a predetermined distance in correspondence with actual length of the workpiece, the wedging unit is displaced corresponding to a deflection curve of the bed and the ram, and the workpiece bent at a proper bending angle throughout the whole length thereof.

15 Claims, 16 Drawing Sheets

PRESS BRAKE

BACKGROUND OF THE INVENTION

The present invention relates to a press brake for bending a workpiece between an upper mold set on a ram and a lower mold set on a bed, and comprises an adjusting unit for adjusting the distance between the upper and lower molds on a workpiece being bent.

In the case of bending a workpiece via a press brake, since a ram and a bed are deflected because of pressure generated in the course of the bending operation, strictly speaking, an angle for bending the workpiece can not be kept constant throughout the whole bending length. In order to correct the error of the bending angle, adjustments are necessary to keep the distance between the upper and lower molds along the length thereof constant during the bending process. To deal with this problem, conventional press brakes are provided with an adjusting unit for adjusting between molds, based on a variety of principles.

FIG. 12 exemplifies structure of such a conventional press brake incorporating an adjusting unit 100.

The reference numeral 101 shown in FIG. 12 designates an upper mold secured to a ram 104 via a holder 103, whereas the reference numeral 102 designates a lower mold held on a table 105. The adjusting unit 100 utilizes the principle of a wedge by way of combining a stationary wedge 111 with a movable wedge 112 to make up a wedging unit 110, which is installed between a bed 106 the table 105.

The movable wedge 112 is interlinked with a reciprocating unit 120 driven by a motor 121. By causing the motor 121 to rotate itself in the clockwise and counterclockwise inverse directions, the movable wedge 112 reciprocates along the length of the molds.

The movable wedge 112 and the stationary wedge 111 of the wedging unit 110 are stacked vertically in contact with each other. As shown in FIG. 13, contacting surface 113 of the movable wedge 112 is in contact with the stationary wedge 111, and is formed of a plurality of inclined planes 113*a*~113*g* having angles of inclination θ1~θ7, and the contacting surface 114 of the stationary wedge is also formed of inclined planes 114*a*~114*g* having angles of inclination θ1~θ7 respectively. The inclined planes 114*a*~114*g* of the stationary wedge 111 are respectively the same as the inclined planes 113*a*~113*g* of the movable wedge 112, wherein each pair of planes contacting each other have identical angles of inclination θ1~θ7 are disposed in vertical engagement with their slopes being vertically inverse.

Among those inclined planes 113*a*~13*g* of the movable wedge 112 and the planes 114*a*~114*g* of the stationary wedge 111, the planes 113*d* and the planes 114*d* at the center positions are respectively set via the largest angle of inclination θ4, followed by the planes 113*c*, 114*c*, 113*e*, and 114*e* on both sides of the planes 113*d* and 114*d* which have the next largest angles of inclination θ3 and θ5. The angles of inclination decrease towards both ends. Angles of inclination θ1~θ4 of the planes 113*a*~113*d* and 114*a*~114*d* from the left ends to the center are respectively related according to the expression θ4>θ3>θ2>θ1, whereas angles of inclination θ5~θ7 of the planes 113*e*~113*g* and 114*e*~14*g* at the right one-half are respectively related according to the expression θ5>θ6>θ7, where θ5=θ3, θ6=θ2, and θ7=θ1. In FIG. 13, and FIGS. 3, 7, 9 and 11 described later, the angles of inclination of respective planes are magnified in order to facilitate explanation, however, actual angles of inclination do not permit visual confirmation.

Simultaneous with descending movement of the ram 104 caused by driving of a pair of linear driving units 107L and 107R disposed on both sides of the ram 104, a workpiece is pressed into a V-shaped groove on the lower mold 102 by the upper mold 101 and thus bent by a certain angle corresponding to the pressing amount. Because of the pressure applied by the bending, a curved deflection shown via broken line in FIG. 14, is generated along the length of the ram 104 and the bed 106. When operating such a press brake equipped with a pair of driving units 107L and 107R set on both sides thereof, deflection of the ram 104 and the bed 106 increases toward the center portions. In FIGS. 14,15 and 16, curved deflection of the ram 104 and the bed 106 is shown to be magnified, however, actual deflection does not permit visual confirmation.

Assume that the amounts of the deflection of the ram 104 and the bed 106 in the bending process are respectively measured at the center positions X1~X7 in portions A~G corresponding to the above-referred inclined planes 113*a*~113*g* and 114*a*~114*g*, and the amounts of deflection are "10" at X4 of the center portion D, "9" at X3 and X5 of the portion C, E, "7" at X2 and X6 of the portion B, F, and "4" at X1 and X7 of the both end portions A, G, then, respective sums of deflected amounts of the ram 104 and the bed 106 at the positions X1 through X7 are "20" at X4, "18" at X3 and X5, "14" at X2 and X6, and "8" at X1 and X7, respectively.

It is assumed that such a state in which the upward planes 113*a*~113*g* of the movable wedge 112 and the downward planes 114*a*~114*g* of the stationary wedge 111 are respectively in firm contact with each other without slipping is introduced as the reference condition in which no amount of adjustment is required. When the reciprocating unit 120 is driven to cause the movable wedge 112 to be shifted to the left (shown via arrowed line in FIG. 13) from the reference condition, the stationary wedge 111 is pushed upward as per the wedge principle, and the stationary wedge 111 is upwardly displaced by an amount of displacement corresponding to the shifted amount of the movable wedge 112.

The upward planes 113*a*~113*g* of the movable wedge 112 are respectively in contact with the corresponding downward planes 114*a*~114*g* of the stationary wedge 111, although the center planes 113*d* and 114*d* of the movable wedge 112 and the stationary wedge 111 respectively have the largest angle of inclination "θ4". Therefore, assume that a pressure is applied to the stationary wedge 111 when it is displaced upward by the shift of the movable wedge 112, an amount of displacement at the center portion D is the largest, whereas the degree of upward displacement is gradually descended toward the end portions A and G to cause the stationary wedge 111 to curve the whole length.

When the respective angles of inclination θ1~θ7 are set so that the ratio of the sums of deflected amounts of the ram 104 and the bed 106 at the respective center positions X1 through X7 of the portions A through G coincides with the ratio of respective angles of inclination θ1~θ7 of the inclined planes 113*a*~113*g*, and 114*a*~114*g* and the movable wedge 112 is shifted by a predetermined distance to cause the stationary wedge 111 to displace to such an extent that the sum of deflected amounts at the center position X4 of the portion D is "20", the amounts of displacement of the stationary wedge 111 become "18" at X3 and X5, "14" at X2 and X6, and "8" at X1 and X7, thus the curved deflection of the ram 104 and the bed 106 is properly corrected. In consequence, the distance between the upper mold 101 and the lower mold 102 is kept constant along the length of the workpiece, thus making it possible to bend the workpiece at a proper bending angle.

However, it should be understood that range a of pressure applied to a workpiece subject to a bending process via a press brake is not always be constant due to lengthwise differences per kind of the workpiece Length L of a workpiece W shown in FIG. 15 is shorter than distance "d" between the pair of driving units 107L and 107R disposed on both sides, whereas length L of another workpiece W shown in FIG. 16 substantially corresponds to the whole length D of the press brake unit.

The above press brake is of such a structure that the ram 104 is subject to pressure at the positions of the driving units 107L ad 107R, whereas the bed 106 is loaded at the positions of a pair of frames 108L and 108R respectively aligned with the driving units 107L and 107R. Therefore, deflected conditions of the ram 104 and the bed 106 are different in accordance with the length L of workpieces W.

In such a case in which the length L of a workpiece W is shorter than distance "d" between the driving units 107L/107R, the ram 104 and the bed 106 during the bending process are respectively deflected into curved forms shown by P1 and Q2 in FIG. 15.

Conversely, if the length L of a workpiece W substantially corresponds to the whole length D of the press brake unit, the ram 104 and the bed 106 during the bending process are respectively deflected into curved forms shown by P2 and Q2 in FIG. 16.

In the curved deflection shown in FIG. 15, assume that the respective deflected amounts of the ram 104 and the bed 106 at the center positions X1~X7 of respective portions A~G are "10" at X4 of the center portion D, "9" at X3 and X5 of the side portions C and E, "7" at X2 and X6 of the portions B and F, and "4" at X1 and X7 of the end portions A and G, sums of deflected amounts of the ram 104 and the bed 106 at positions X1~X7 are "20" at X4, "18" at X3 and X5, "14" at X2 and X6, and "8" at X1 and X7. Whereas in the curved-form deflection shown in FIG. 16, assume that the respective deflected amounts are "10" at X4, "7" at X3 and X5, "2" at X2 and X6, and "3" at X1 and X7, sums of deflected amounts are "20" at X4, "14" at X3 and X5, "4" at X2 and X6, and "6" at X1 and X7.

According to the curved deflection shown in FIG. 15 and the other curved deflection shown in FIG. 16, ratios of the deflected amounts at positions X1~X7 are not identical to each other. In consequence, when operating the above-cited conventional adjusting unit 100, the curved deflection shown in FIG. 15 can properly be compensated, but the curved deflection shown in FIG. 16 cannot be compensated, so it is impossible to deal with workpieces having a variety of length, thus raising a problem.

SUMMARY OF THE INVENTION

The invention is provided to fully solve the above problem. The object of the invention is to provide a novel press brake capable of setting a proper bending angle throughout the whole length of a workpiece independent of the length of the workpiece by way of composing a wedging unit to be capable of dealing with deflection of a variety of curved forms of the ram and the bed.

According to an embodiment of the invention, a press brake is provided, which comprises a bed for supporting a lower mold on the upper surface thereof, a ram for supporting an upper mold in opposition to said lower mold, a driver for causing either the ram or the bed to move vertically for bending a workpiece between the upper and lower molds, and a distance adjusting device for adjusting the distance between the upper and lower molds.

The distance adjusting device comprises a wedging unit which is disposed either between the ram and the upper mold or between the bed and the lower mold, and a pair of reciprocating units. The wedging unit comprises a pair of movable wedges and a stationary wedge disposed between the movable wedges and in contact with the movable wedges, wherein each of the contacting surfaces of the wedges is formed by a plurality of inclined planes having different angles of inclination in series. And the reciprocating units are connected to the movable wedges respectively to move the movable wedges along the length of the molds.

According to the press brake comprising the above structure, when the movable wedge disposed in the lower position is shifted by the corresponding reciprocating unit, the stationary wedge and the upper movable wedge are integrally displaced in the vertical direction to an extent corresponding to the shifted amount of the lower wedge. When the upper wedge is shifted, the upper wedge is displaced in the vertical direction in accordance with its own shift. When both of the upper and lower movable wedges are shifted, the stationary wedge and the upper movable wedge are integrally displaced in the vertical direction to an extent corresponding to the shifted amounts of the both movable wedges. Since each of the contacting surfaces of the wedges is formed by a plurality of inclined planes having different angles of inclination in series, the displaced amounts at positions of the respective inclined planes agree with the sums of the displaced amounts at positions of the respective planes of the stationary wedge and the upper movable wedge. Therefore, by applying the sums of displaced amounts to the curved deflection of the ram and the bed, deflection of the ram and the bed can fully be corrected.

Accordingly, by causing at least either of a pair of movable wedges to be shifted, the wedging unit can be operated to deal with a variety of curved deflections of the bed and the ram, and thus, workpieces having a variety of length can be bent at proper bending angles.

An aspect of the distance adjusting device also comprises a pair of wedging units and a pair of reciprocating units corresponding to the wedging units, and the wedging units are disposed either between the ram and the upper mold or between the bed and the lower mold.

The distance adjusting device may also comprise a pair of wedging units and a pair of reciprocating units corresponding to the wedging units, wherein one of the wedging units is disposed between the ram and the upper mold, and the other is disposed between the bed and the lower mold.

In the second and third aspect, each of the wedging units comprises a movable wedge and a stationary wedge which are vertically disposed being in contact with each other, wherein each of the contacting surfaces of the wedges is formed by a plurality of inclined planes having different angles of inclination in series. And the reciprocating units are connected to the movable wedges of the wedging units respectively to move the movable wedges along the length of the molds.

According to the above-referred second and third aspects, by shifting the movable wedge of at least either of the first and second wedging unit, either the movable wedge or the stationary wedge in contact with the movable wedge is displaced in the vertical direction to an extent corresponding to the shifted amount of the movable wedge. Since each of the contacting surfaces of the wedges of the first and second wedging units is formed by a plurality of inclined planes having different angles of inclination in series, displaced amounts at the positions of respective inclined planes agree with the sums of the displaced amounts at the positions of respective planes of the stationary wedge or the movable wedge of the first wedging unit and the displaced amounts at the positions of respective planes of the stationary wedge or the movable wedge of the second wedging unit. By applying the sums of displaced amounts to the curved deflection of the ram and the bed, deflection of the ram and the bed can fully be corrected.

The distance adjusting device in the above-referred aspects, preferably comprises supporting means for supporting load(s) applied to the movable wedges during shifting thereof. Accordingly, in the course of shifting any movable wedge via operation of the corresponding reciprocating unit, the load applied to the movable wedge is supported by the supporting unit, so the movement of movable wedge and the displacement of the movable wedge and the stationary wedge in the vertical direction, can be done smoothly, to effectively prevent wear of the wedges.

DETAILED DESCRIPTION OF THE INVENTION

Figure 1:
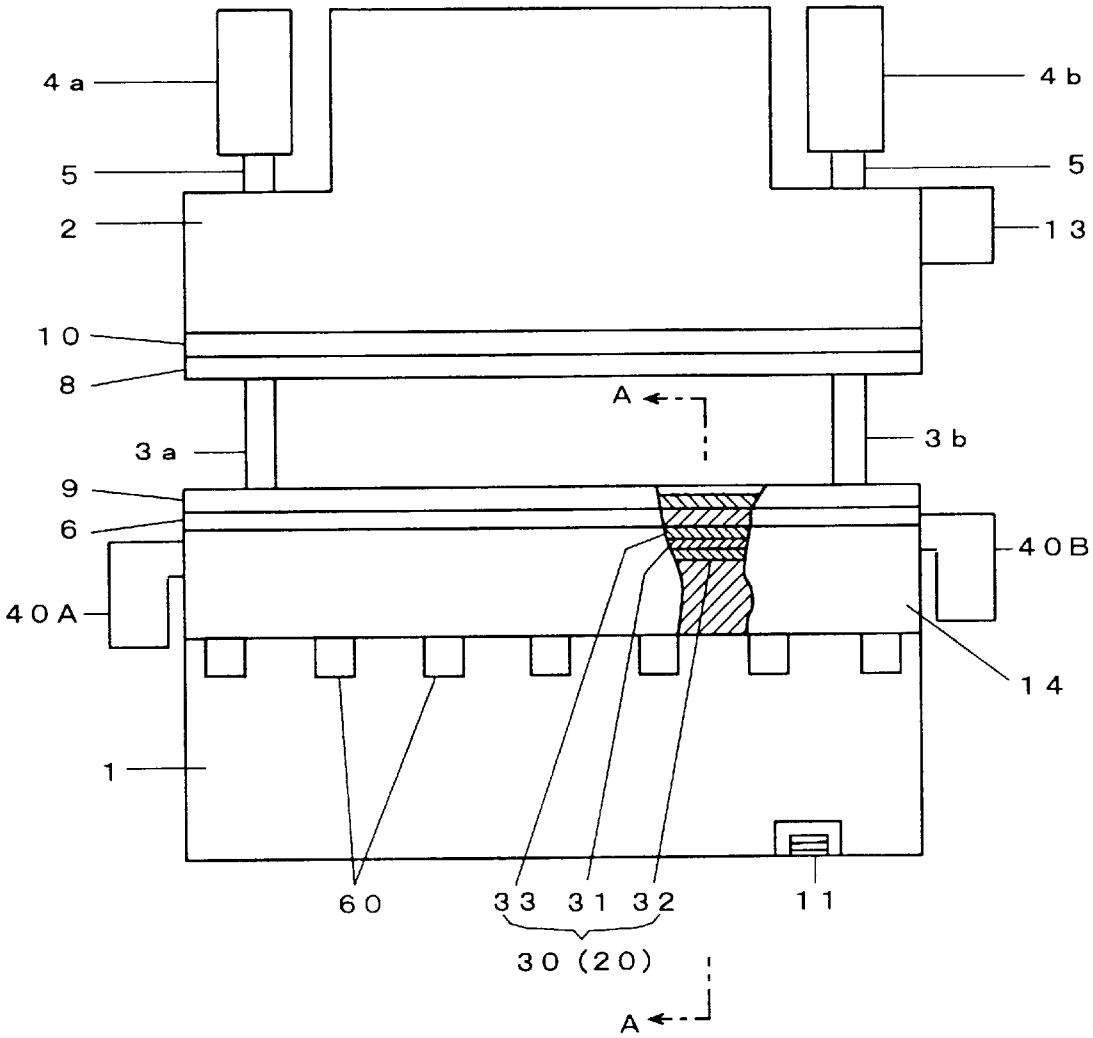
FIG. 1 is a partial cross-sectional front view of a press brake according to an embodiment of the invention, showing the cross section of an adjusting unit for adjusting upper-lower molds distance.

FIG. 1 shows a press brake according to an embodiment of the invention. The reference numerals 1 and 2 shown in FIG. 1 respectively designate a bed and a ram vertically disposed in opposition to each other. End portions of the bed 1 are integrally supported by a pair of frames 3*a* and 3*b*. A pair of hydraulic cylinders 4*a* and 4*b* function as linear driving units and are disposed at upper ends of the frames 3*a* and 3*b*. The ram 2 is connected to the bottom ends of cylinder rods 5 of the hydraulic cylinders 4*a* and 4*b* of low parts at both ends of the ram 2.

The driving units for moving the ram 2 up and down are not only limited to the hydraulic cylinders 4*a* and 4*b* but a Fair of ball-screws driven by discrete servomotors may also be used. In the press brake according to this embodiment, the ram 2 is vertically operated. However, the scope of the invention is not solely limited to the ram's movement, but the invention is also applicable to such a version causing the bed 1 to move up and down as well.

Figure 2:
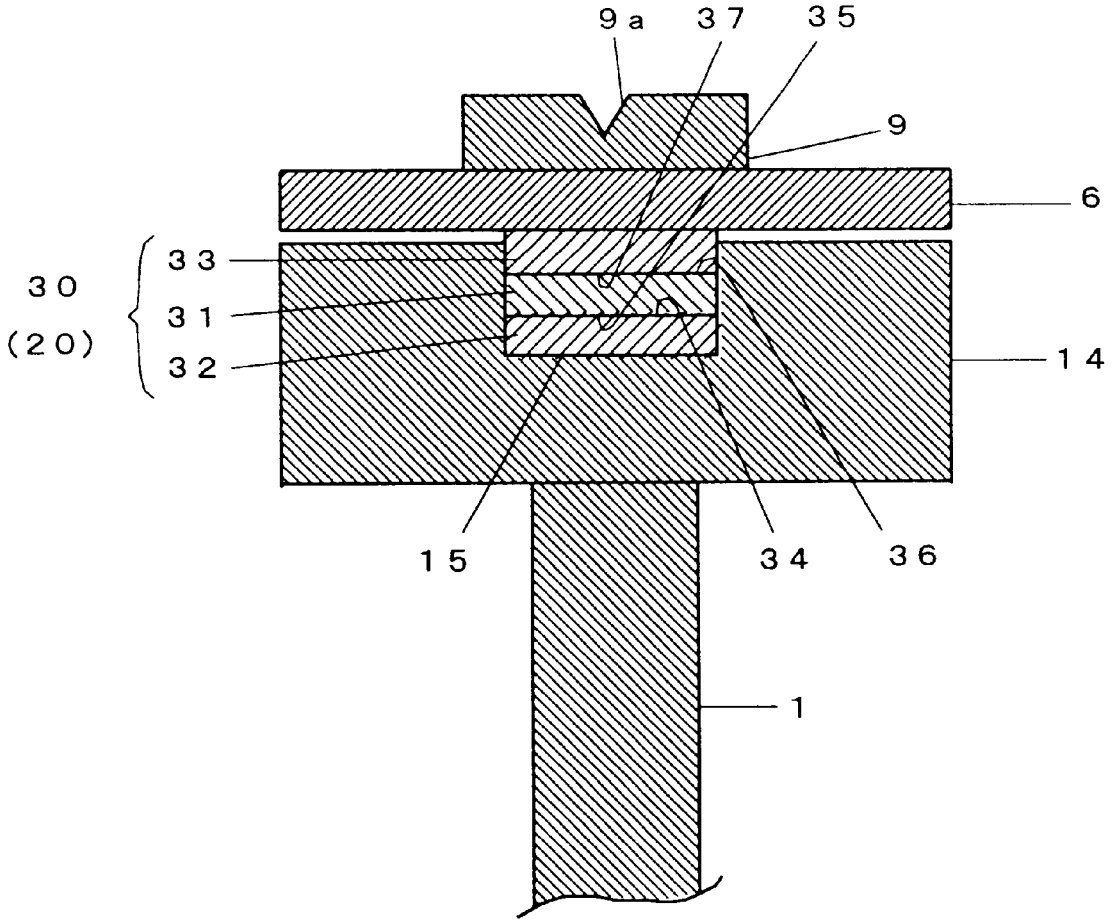
FIG. 2 is a cross-sectional view along line A—A of FIG. 1.

As shown in FIG. 2, a table base 14 is integrally formed at the upper portion of the bed 1, and a wedging unit 30 of an adjusting unit 20 is held inside a supporting groove 15 formed on the upper surface of the table-base 14. Table 6 is held on the wedging unit i 30, and a lower mold 9 is secured onto the table 6. A upper mold 8 is secured to the bottom-end portion of the ram 2 via a holder 10. In a bending process, when a workpiece is inserted between the upper mold 8 and the lower mold 9 and positioned on the lower mold 9, and a foot-pedal 11 is operated, the respective cylinders 4*a* and 4*b* are operated to lower the ram 2. Then the workpiece is pressed into V-shaped groove 9*a* of the lower mold 9 by the upper mold 8 and bent.

A control box 13 is set to a lateral surface of the press brake. In the box 13, there is a controller for controlling operation of the press brake, the controller comprises a CPU for executing control and arithmetic operations and memories such as RAM and ROM. Although not being illustrated, the controller is electrically connected an operation panel having a display and a keyboard.

The wedging unit 30 includes an adjusting unit 20 for adjusting the distance between the upper-lower molds 8, 9, in conjunction with first and second reciprocating units 40A and 40B, or linear positions, at the ends, and a supporting unit 60 set to the table base 14.

The wedging unit 30 of this embodiment is disposed between the table base 14 of the bed 1 and the table 6, and the unit 30 comprises a pair of movable wedges 32, 33 vertically opposed, and a stationary wedge 31 between the movable wedges 32, 33. The first movable wedge 32 disposed in the lower position, is held by the supporting groove 15 of the table-base 14, and the upper surface of the wedge 32 and the bottom surface of the stationary wedge 31 are in firm contact with each other thereby providing first contacting surfaces 34 and 35. Upper surface of the stationary wedge 31 and the bottom surface of the second movable wedge 33 disposed in the upper position, are in firm contact with each other thereby providing second contacting surfaces 36 and 37. The bottom surface of the first movable wedge 32 and the upper surface of the second movable wedge 33 are flattened. The table 6 is held on the upper surface of the second movable wedge 33.

Figure 3:
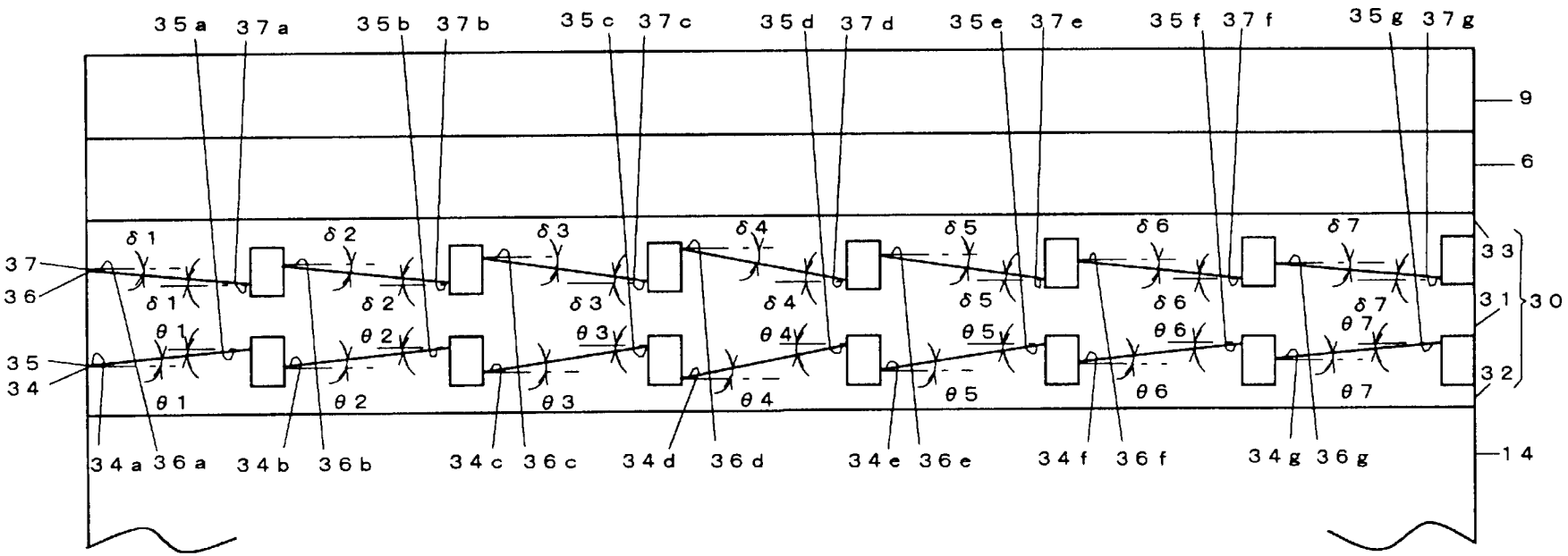
FIG. 3 is an enlarged front view of a wedging unit.

As shown in FIG. 3, the first contacting surface 34 of the movable wedge 32 is formed by a plurality of upward inclined planes 34*a*~34*g* having different angles of inclination θ1~θ7 in series. The first contacting surface 35 of the stationary wedge 31 comprises a plurality of downward inclined planes 35*a*~35*g* opposed to said planes 34*a*~34*g* and having angles of inclination θ1~θ7 identical to the opposite planes 34*a*~34*g* respectively.

The second contacting surface 36 of the stationary wedge 31 is formed by a plurality of upward inclined planes 36*a*~36*g* having different angles of inclination δ1~δ7 in series. The second contacting surface 37 of the second movable wedge 33 comprises a plurality of downward inclined planes 37*a*~37*g* opposed to the planes 36*a*~36*g* and having angles of inclination δ1~δ7 to the opposite planes 36*a*~36*g* respectively.

The wedges 31, 32, and 33 exemplified have 7 inclined planes respectively, but the number of planes are not limited to 7. It should be understood that finer adjustment can be executed by way of increasing the number of the inclined planes. It is also practicable that each of the planes of the respective wedges 31, 32 and 33 is formed by combining plurality of inclined planes having different angles of inclination.

Figure 15:
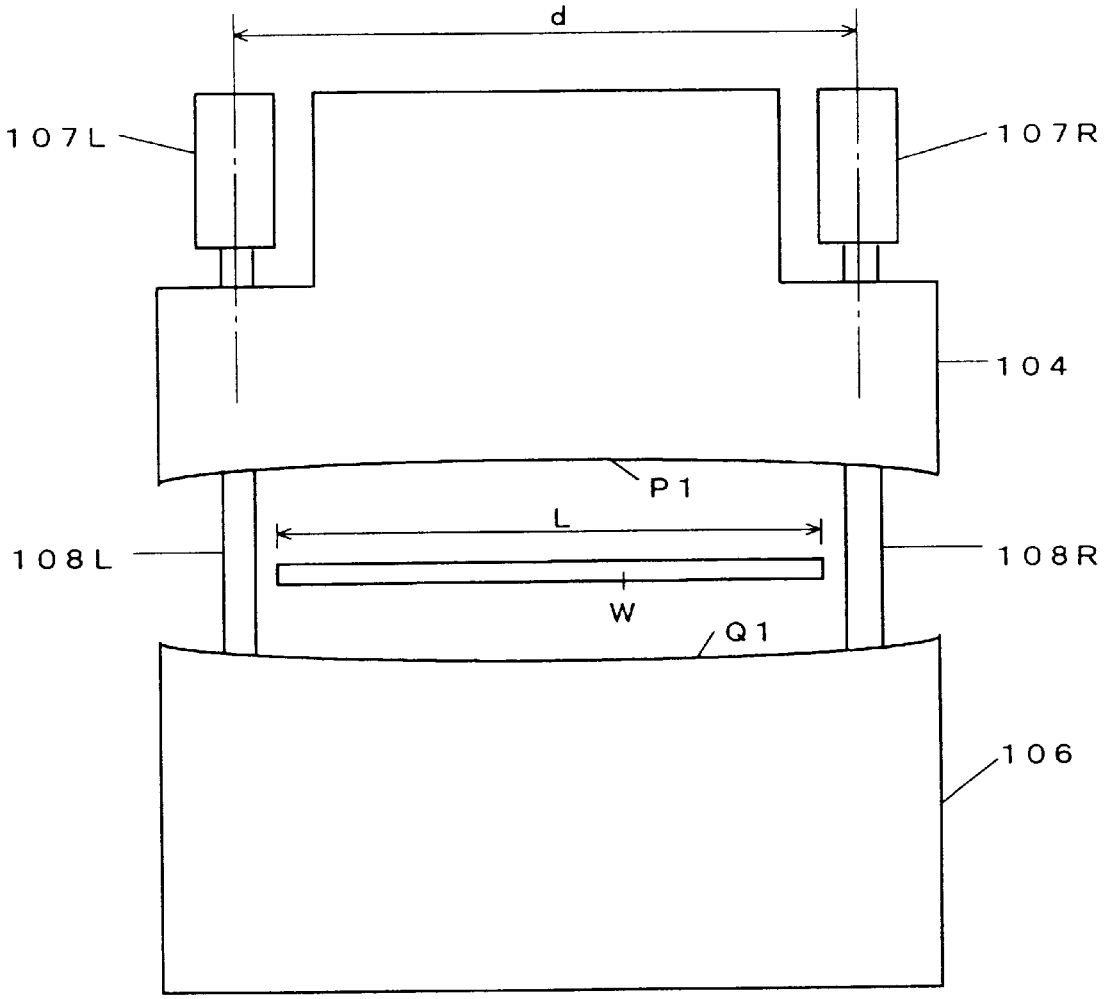
FIG. 15 is a view showing a deflected condition of a ram and a bed when bending a short workpiece.

In this embodiment, the angles of inclination θ1~θ7 of the planes 34*a*~34*g* and 35*a*~35*g* are respectively preset in order that the ratio of the angles θ1~θ7 coincides with the ratio of the sums of deflected amounts at said respective positions X1~X7 in the curved deflection shown in FIG. 15. Further, angles of inclination θ1~θ7 of the planes 36*a*~36*g* and 37*a*~37*g* are preset in order that ratio of the angles δ1~δ7 coincides with the ratio of the sums of deflected amounts at respective positions X1~X7 in the curved deflection shown in FIG. 16.

The stationary wedge 31 and the first and second movable wedges 32, 33 in this embodiment, are integrated. However, as shown in FIG. 7, it is also practicable to form the wedges 31, 32 and 33 by respectively coupling a plurality of blocks 31BL1~31BL7, 32BL1~32BL7, and 33BL1~33BL7 which have independent inclined planes respectively.

Figure 7:
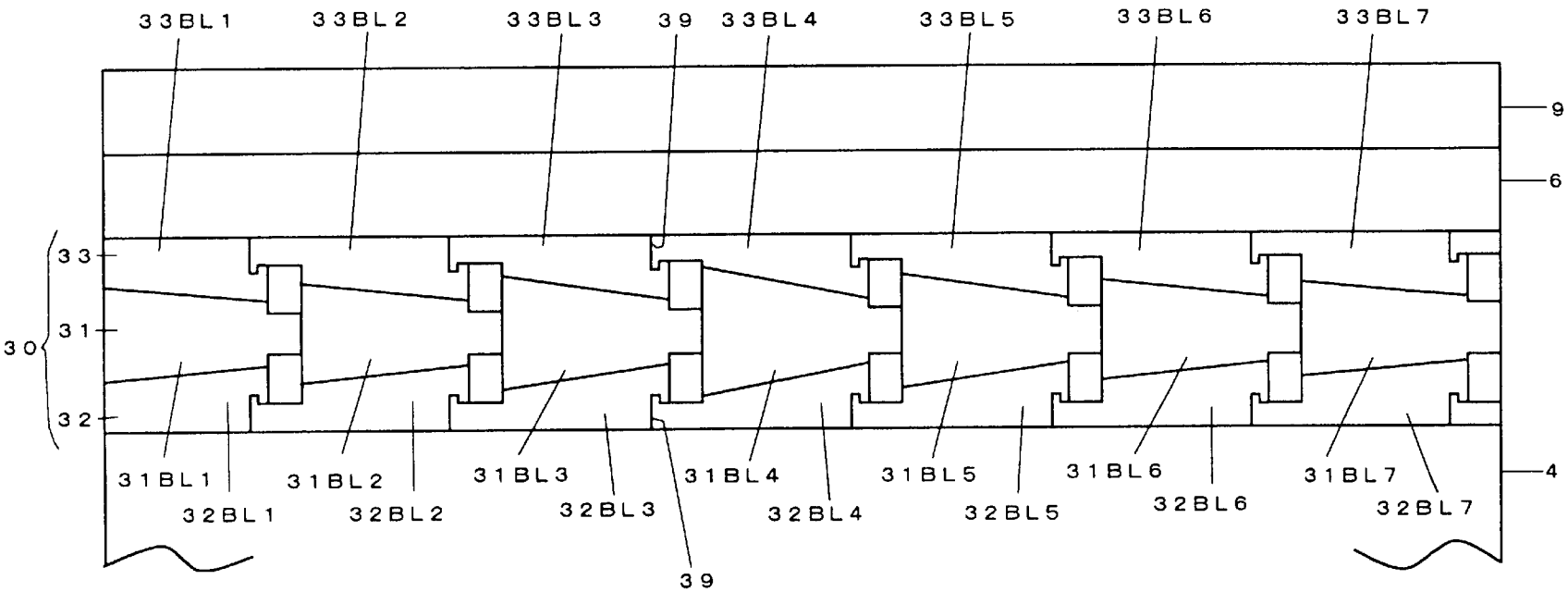
FIG. 7 is an enlarged front view of a wedging unit according to another embodiment of the invention.

In connection with the movable wedges 32 and 33 shown in FIG. 7, coupling units 39 are preferably installed between adjoining blocks 32BL1~32BL7, and 33BL1~33BL7 to connect the blocks with each other and shift all the blocks simultaneously. However, if the first and second movable wedges 32 and 33 are respectively provided with two types of shifting units for shifting the wedges 32 and 33 toward the different directions respectively, the above coupling units 39 are not always required.

If the stationary wedge 31 and the movable wedges 32 and 33 are formed by way of coupling a plurality of blocks respectively, it is possible to freely combine sloped blocks each having different angles of inclination.

Figure 4:
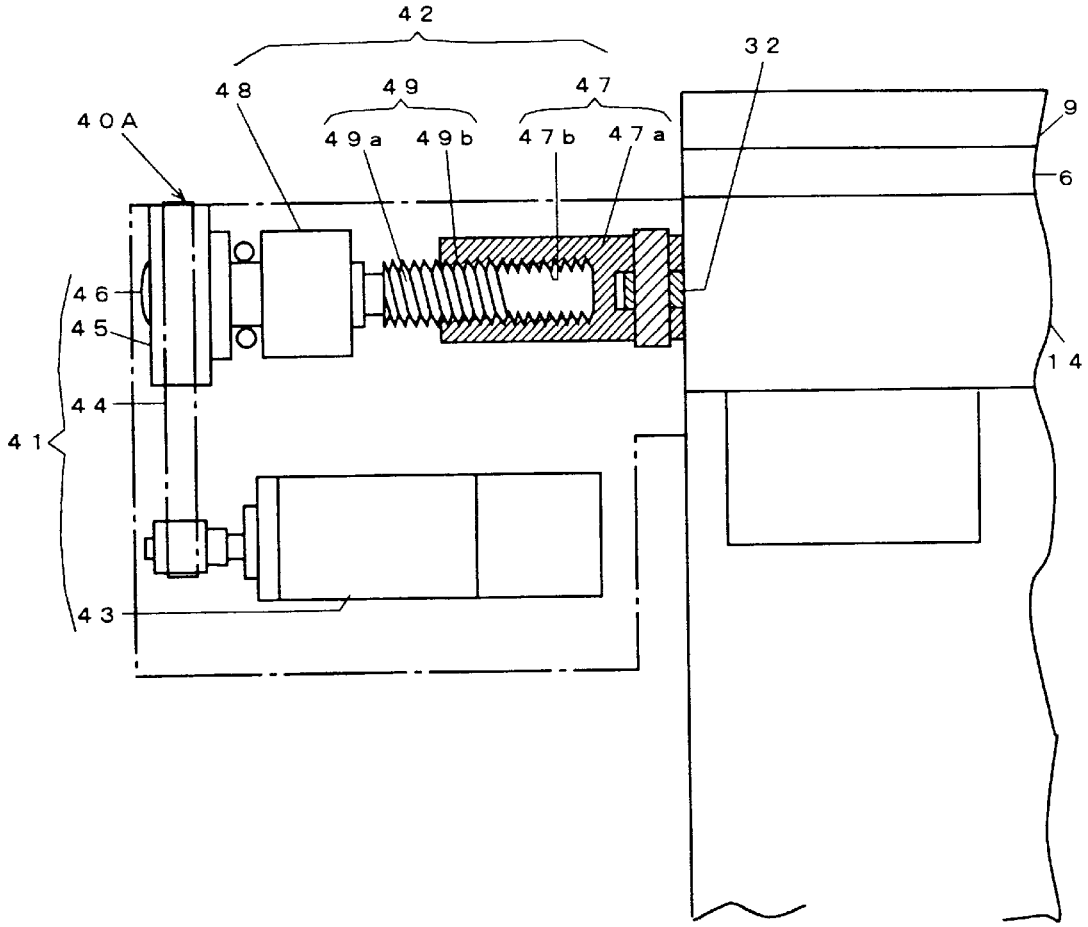
FIG. 4 is a front view showing structure of a first reciprocating unit.
Figure 5:
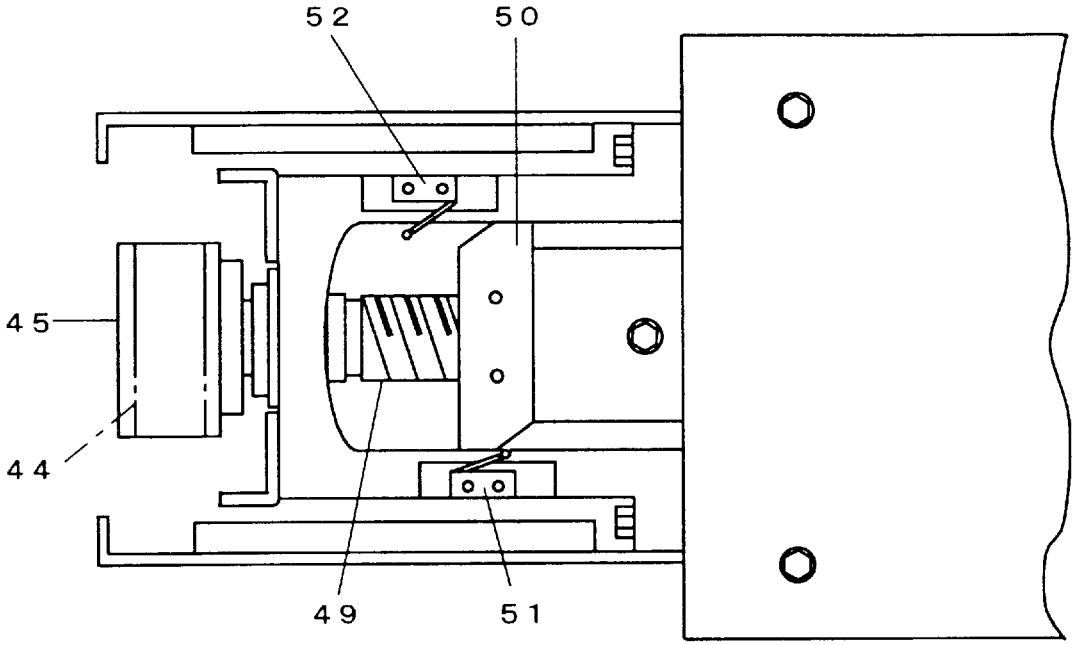
FIG. 5 is a plan view showing structure of the first reciprocating unit.

FIGS. 4 and 5 respectively designate structure of the first reciprocating unit 40A.

The reciprocating unit 40A causes the first movable wedge 32 to reciprocate along the length of the molds, where the lengthwise direction corresponds to the lateral direction in FIGS. 1 and 3, and the unit 40A is set to one end in the lateral direction of the bed 1. The other end of the bed 1 is provided with the second reciprocating unit 40B for causing the second movable wedge 33 to reciprocate along the length of the molds. The second reciprocating unit 40B has the same structure as that of the first reciprocating unit 40A, so the following description solely refers to the structure of the first reciprocating unit 40A and omits description of the second reciprocating unit 40B.

The reciprocating unit 40A exemplified comprises a driver 41 and a transmission 42 which converts rotary movement of the driver 41 into linear movement to transmit the linear movement to the first movable wedge 32. The driver 41 comprises a motor 43 rotating in the clockwise and counterclockwise directions, a pulley 45 connected to the motor 43 via a belt 44, and a rotary shaft 46 connected to the pulley 45, by which the rotary shaft 46 integrally rotates with the rotation of the motor 43.

The transmission 42 includes a internal thread 47 secured to the first movable wedge 32 and a external thread 49 connected to the rotary shaft 46 via a coupling 48. The internal thread 47 is provided by a cylindrical body 47*a* with a threaded hole 47*b* on the internal surface thereof. The external thread hole 47*b* on the internal surface thereof. The external thread 49 is provided by a shaft 49*a* provided with a screw thread 49*b* which is engaged to the thread 47*b*. When the external thread 49 is rotated by the motor 43, the internal thread 47 engaged with the thread 49 performs linear movement shifting the first movable wedge 32. The reference numeral 50 shown in FIG. 5 designates a cam moved by the internal thread 47 for turning on and off limit switches 51 and 52 in accordance with the reciprocation of the thread 47. The switches 51 and 52 are for restricting the movable range of the first movable wedge 32, and when the switches 51 and 52 are depressed by the cam 50, the motor 43 stops rotation.

Figure 6:
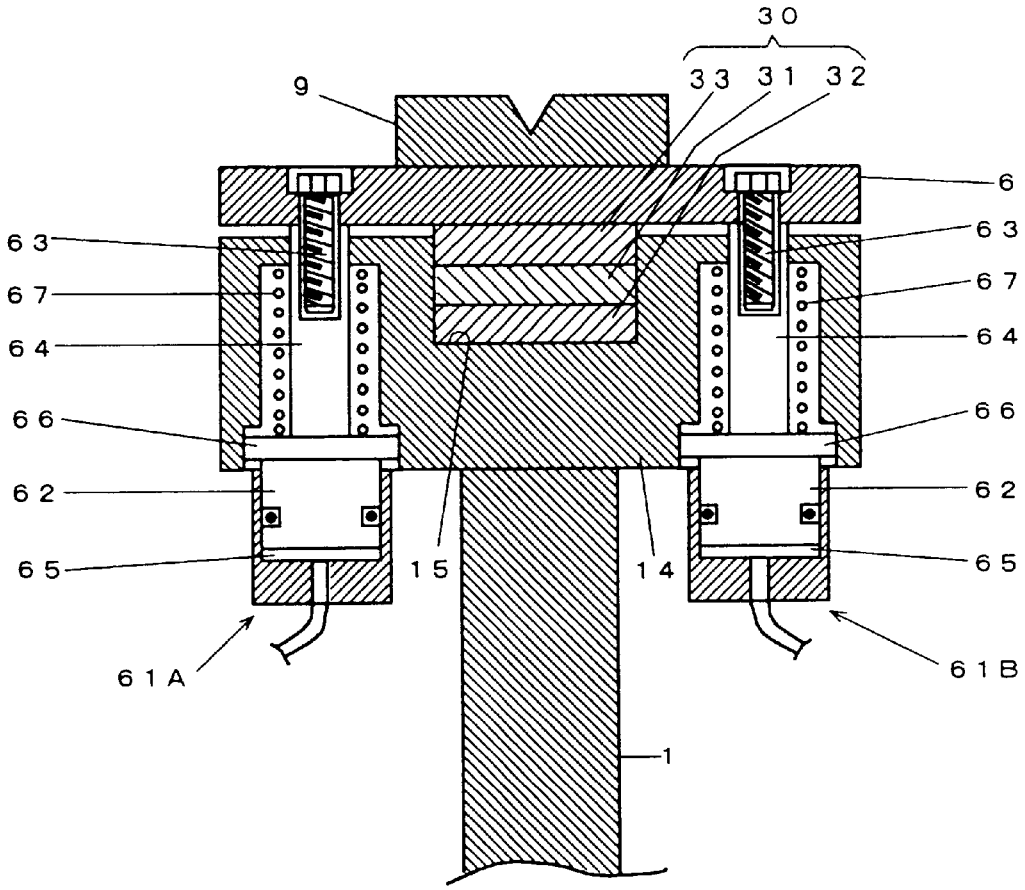
FIG. 6 is a cross-sectional view showing structure of the supporting unit.

FIG. 6 designates structure of the supporting unit 60. The supporting unit 60 supports the load applied to the movable wedges 32 and 33 during their reciprocation. The supporting unit 60 pushes the table 6 onto the wedging unit 30 along the whole length of the table 6, after adjusting the distance between the molds by the reciprocation of the wedges 32 and 33, to cause the contacting surfaces 34 and 35 of the first movable wedge 32 and the stationary wedge 31 as well as the contacting surfaces 36 and 37 of the stationary wedge 31 and the second movable wedge 33, to respectively be in firm contact with each other.

The supporting unit 60 exemplified comprises a predetermined number of pairs of cylinder units 61A and 61B respectively disposed before and behind along the length of the wedging unit 30 at predetermined intervals, in which the cylinder units 61A and 61B are respectively set inside of the table base 14. Each of the cylinder units 61A and 61B incorporates a piston 62 and a cylinder shaft 64 whose tip is secured to the table 6 with a bolt 63. By way of feeding hydraulic fluid into a cylinder mantel 65, the table 6 is pushed upward via extruding movement of the piston 62 and the cylinder shaft 64 to support the load applied to the table 6 and the lower mold 9. The reference numeral 66 shown in FIG. 6 designates a washer integrated with the piston 62. By causing spring pressure of a compressed spring 67 to act on the washer 66, the table 6 is pressed to the wedging unit 30.

The wedging unit 30 is not necessarily disposed between the bed 1 and the table 6, it may be disposed between the ram 2 and the holder 10.

Figure 8:
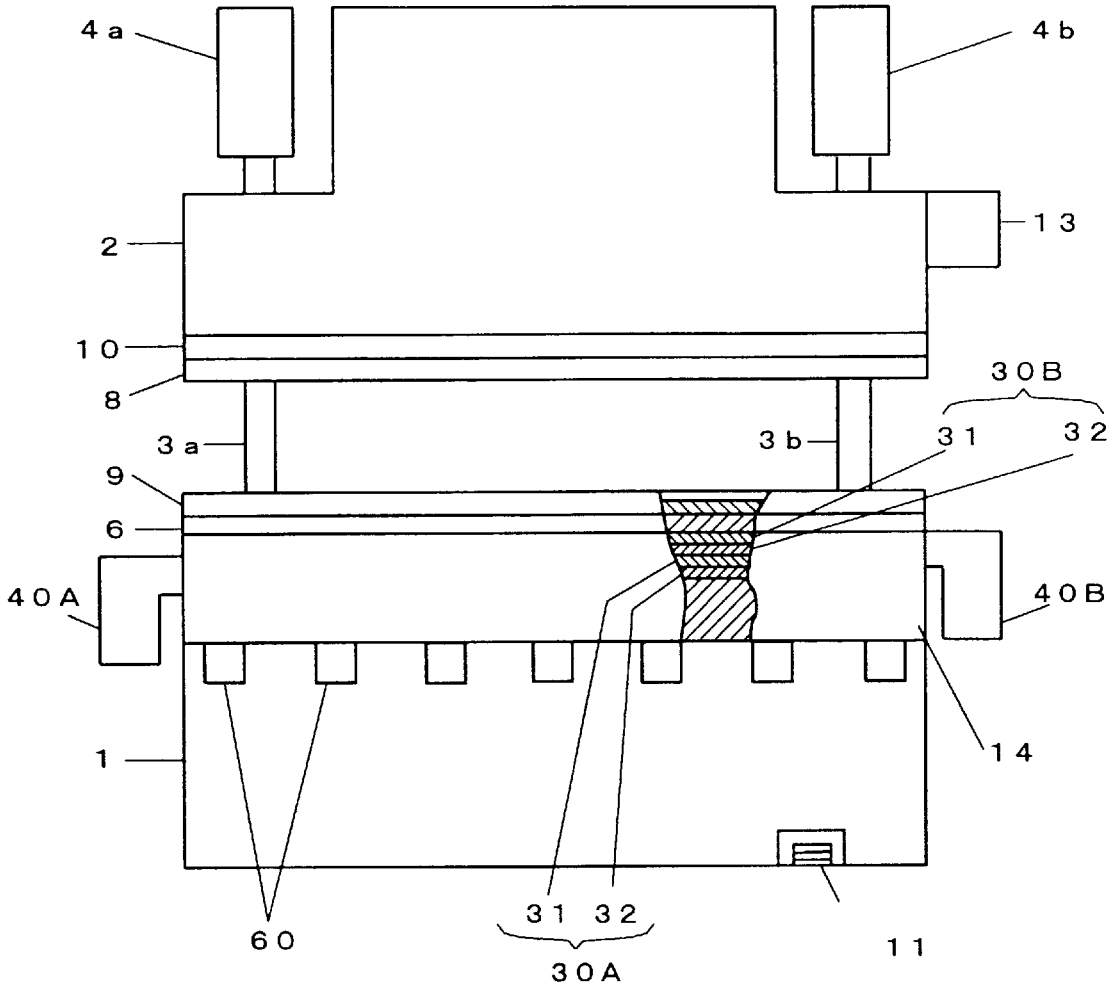
FIG. 8 is a partial cross-sectional front view of a press brake according to another embodiment of the invention, showing a cross section of an adjusting unit.
Figure 10:
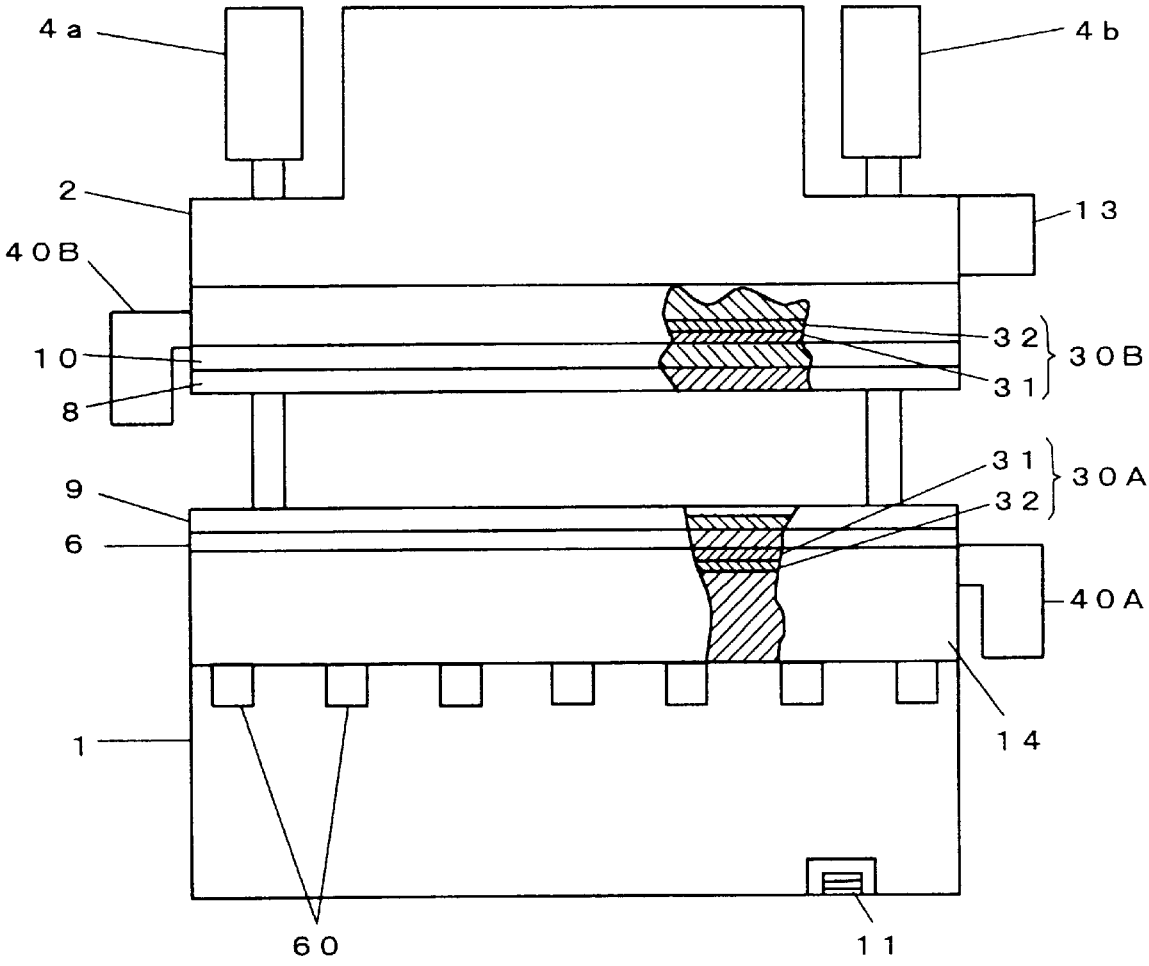
FIG. 10 is a partial cross-sectional front view of a press brake according to another embodiment of the invention, showing a cross section of an adjusting unit.

The press brake according to the above embodiment comprises a single unit of the wedging unit 30 which is structured by combining a single unit of the stationary wedge 31 with a pair of movable wedges 32 and 33. Instead, as shown in FIGS. 8 and 10, the press brake may be also have a pair of wedging units 30A and 30B each having a single stationary wedge 31 and a single movable wedge 32. The wedging units 30A and 30B may be disposed vertically in contact with each other between the-bed 1 and the table 6 as shown in FIG. 8, or the wedging units 30A and 30B may be disposed between the bed 1 and the table 6 and between the ram 2 and the holder 10 respectively, as shown in FIG. 10.

In the embodiment shown in FIG. 8, the first wedging unit 30A is disposed on the table base 14 of the bed 1, the second wedging unit 30B is disposed on the first wedging unit 30A, and the table 6 is disposed on the second wedging unit 30B, serially contacting each other.

The upper surface of the movable wedge 32 and the bottom surface of the stationary wedge 31 of the first wedging unit 30A are in firm contact with each other to respectively form the first contacting surfaces 34 and 35. The upper surface of the movable wedge 32 and the bottom surface of the stationary wedge 31 of the second wedging unit 30B are also in firm contact with each other to respectively form the second contacting surfaces 36 and 37.

The movable wedges 32, 32 of the first and second wedging unit 30A and 30B are connected to the first and second reciprocating units 40A and 40B respectively for reciprocating the wedges 32, 32 along the length of the molds.

Figure 9:
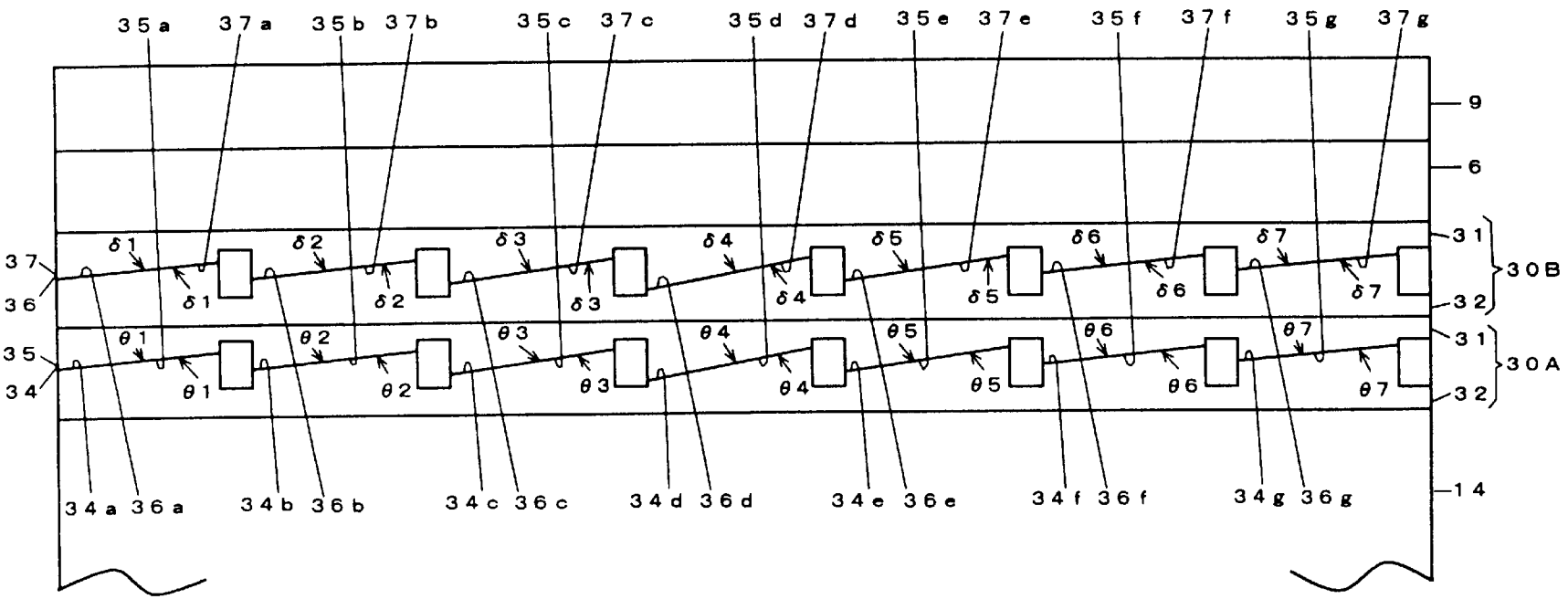
FIG. 9 is an enlarged front view of the wedging unit according to the embodiment shown in FIG. 8.

As shown in FIG. 9, the contacting surface 34 of the movable wedge 32 of the first wedging unit 30A is formed by a plurality of upward inclined planes 34*a*~34*g* having different angles of inclination θ1~θ7 in series. The contacting surface 35 of the stationary wedge 31 comprises a plurality of downward inclined planes 35*a*~35*g* opposed to said planes 34*a*~34*g* and having angles of inclination θ1~θ7 identical to the opposite planes 34*a*~34*g* respectively.

The contacting surface 36 of the movable wedge 32 of the second wedge unit 30B comprises a plurality of upward inclined planes 36*a*~36*g* having different angles of inclination δ1~δ7. The second contacting surface 37 of the stationary wedge 31 comprises of a plurality of downward inclined planes 37*a*~37*g* opposed to said planes 36*a*~36*g* and having angles of inclination δ1~δ7 identical to the opposite planes 36*a*~36*g* respectively.

In this embodiment, the angles of inclination θ1~θ7 of the planes 34*a*~34*g* and 35*a*~35*g* of the first wedging unit 30A, are set so that the ratio of the angles θ1~θ7 coincides with that of the sums of deflected amounts at positions X1~X7 in the curved deflection shown in FIG. 15. Whereas, the angles of inclination δ1~δ7 of the planes 36*a*~36*g* and 37*a*~37*g* are set so that the ratio of the angles δ1~δ7 coincides with that of the sums of deflected amounts at positions X1~X7 in the curved deflection shown in FIG. 16.

In the above embodiment, both of the first and second wedging units 30A and 30B are disposed between the bed 1 and the table 6. However, it is also practicable to dispose them between the ram 2 and the holder 10.

Furthermore, in the above embodiment, the stationary wedge 31 is displaced in the vertical direction via shifting movement of the movable wedge 32. However, it is also practicable to arrange it so that the movable wedge 32 is displaced in the vertical direction in accordance with its own shift, as are the stationary wedge 31 and the movable wedge 33 shown in FIG. 1.

In the embodiment shown in FIG. 10, the first wedging unit 30A is disposed between the bed 1 and the table 6, whereas the second wedging unit 30B is disposed between the ram 2 and the holder 10.

The upper surface of the movable wedge 32 and the bottom surface of the stationary wedge 31 of the first wedging unit 30A are in firm contact with each other to form the first contacting surfaces 34 and 35. Whereas the bottom surface of the movable wedge 32 and the upper surface of the stationary wedge 31 of the second wedging unit 30B are in firm contact with each other to form the second contacting surfaces 36 and 37.

The movable wedges 32, 32 of the first and second wedging unit 30A and 30B are connected to the first and second reciprocating unit 40A and 40B respectively to reciprocate the movable wedges 32 to along the length of the molds.

Figure 11:
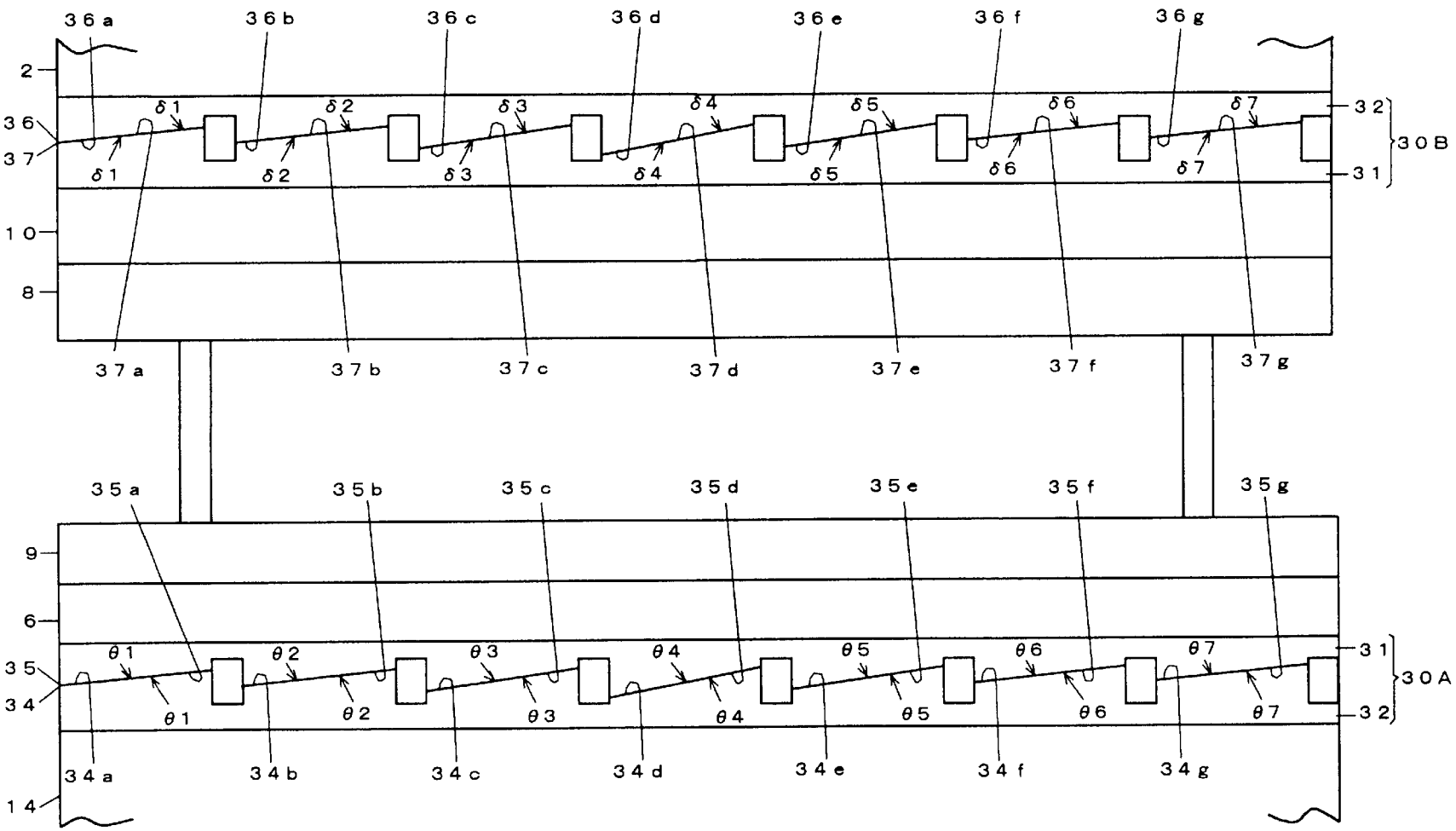
FIG. 11 is an enlarged front view of a wedging unit according to the embodiment shown in FIG. 10.
Figure 12:
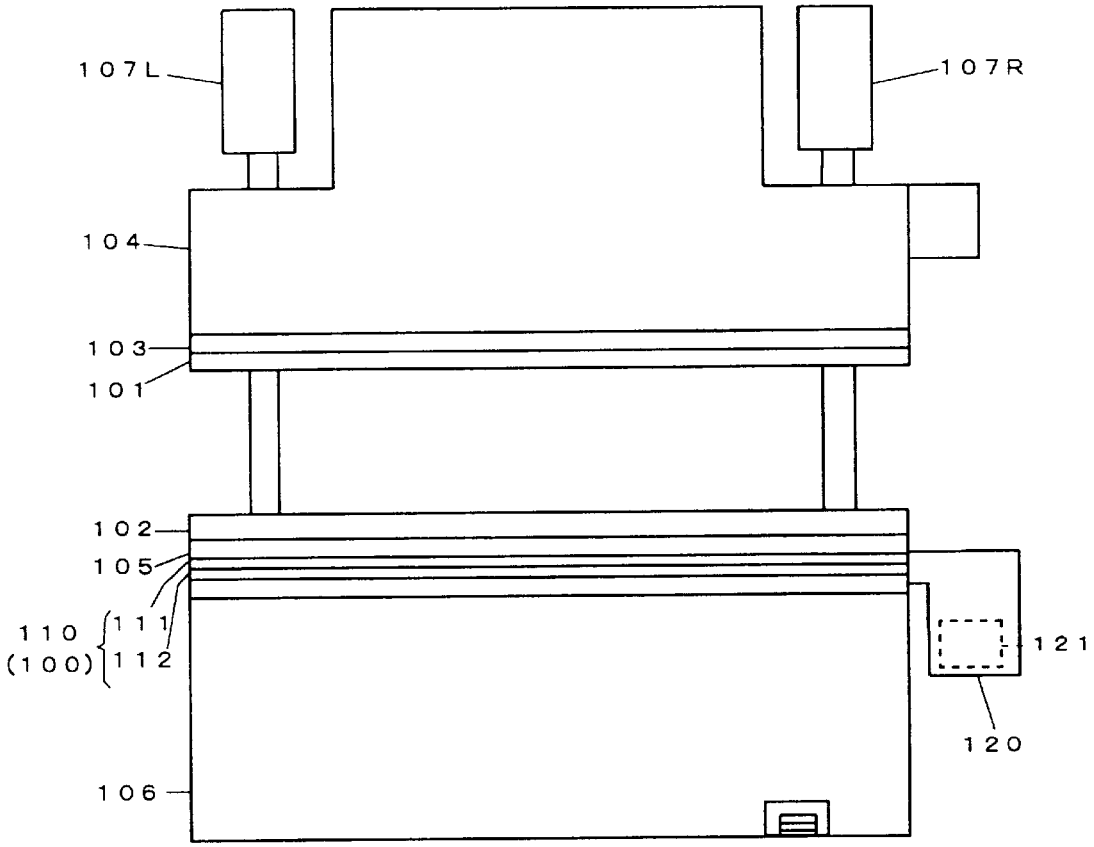
FIG. 12 is a front view showing structure of a conventional press brake incorporating an adjusting unit.
Figure 13:
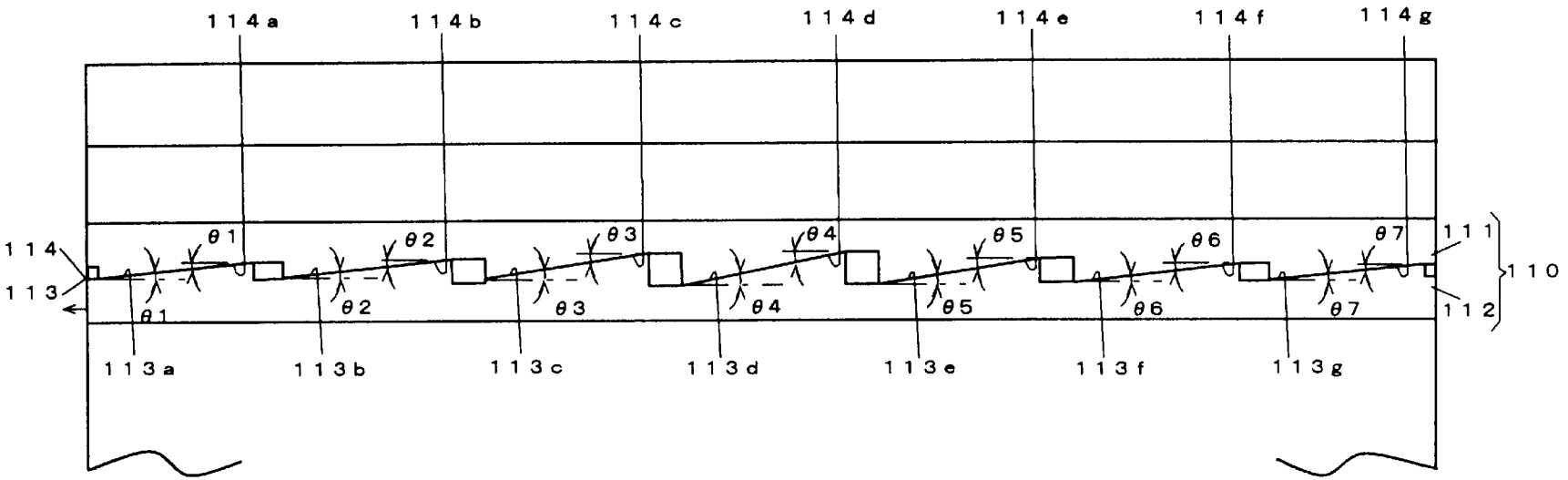
FIG. 13 is an enlarged front view of a conventional wedging unit shown in FIG. 12.
Figure 14:
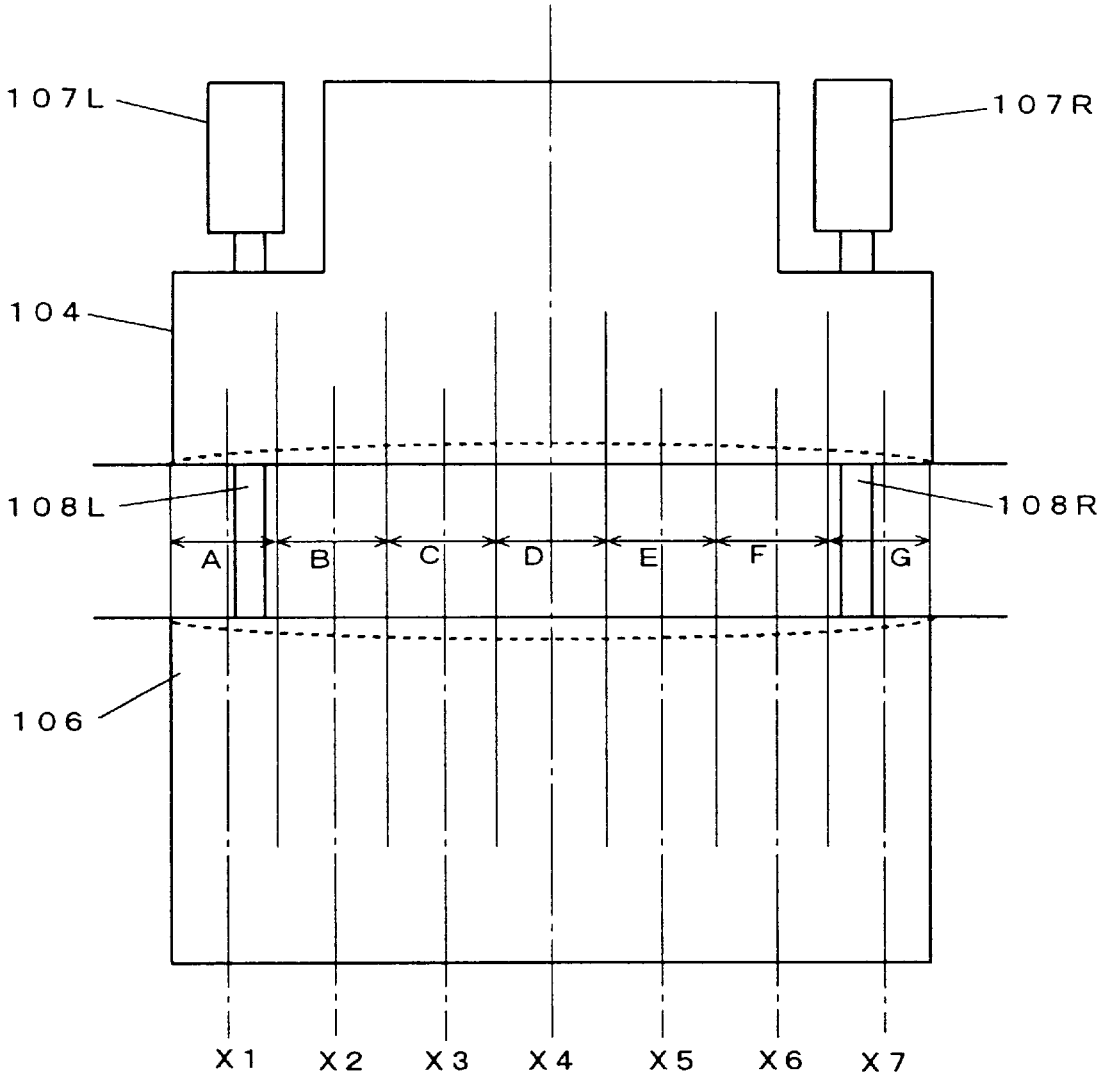
FIG. 14 is a view showing a deflected condition of a ram and a bed.

As shown in FIG. 11, in the first wedging unit 30A, the contacting surface 34 of the movable wedge 32 comprises a plurality of upward inclined planes 34*a*~34*g* having different angles of inclination θ1~θ7. And the contacting surface 35 of the stationary wedge 31 comprises a plurality of downward inclined planes 35*a*~35*g* opposed to the planes 34*a*~34*g* and having angles of inclination θ1~θ7 identical to the opposite planes 34*a*~34*g* respectively.

Whereas in the second wedging unit 30B, the contacting surface 36 of the movable wedge 32 comprises a plurality of downward inclined planes 36*a*~36*g* having different angles of inclination δ1~δ7. And the contacting surface 37 of the stationary wedge 31 comprises a plurality of continuing upward surfaces 37*a*~37*g* opposed to the planes 36*a*~36*g* and having angles of inclination δ1~δ7 identical to the opposite planes 36*a*~36*g* respectively.

The angles of inclination θ1~θ7 of the planes 34*a*~34*g* and 35*a*~35*g* of the first wedging unit 30A are set so that the ratio of the angles θ1~θ7 coincides with the ratio of the sums of deflected amounts at positions X1~X7 in the curved deflection shown in FIG. 15. Whereas the angles of inclination δ1~δ7 of the planes 36*a*~36*g* and 37*a*~37*g* of the second wedging unit 30B are set so that the ratio of the angles δ1~δ7 coincides with the ratio of the sums of deflected amounts at positions X1~X7 in the curved deflection shown in FIG. 16.

It is also practicable to arrange the embodiment so that each of the movable wedges 32 and 32 of the both wedging units 30A and 30B can be displaced in the vertical direction via shift of the movable wedge 32 itself.

Next, the process for bending a workpiece by operating the press brake according to the embodiment shown in FIG. 1 is described below.

When the length L of a workpiece is shorter than distance "d" between hydraulic cylinders 4*a* and 4*b* disposed on the ends as exemplified in FIG. 15, the respective pairs of cylinders 61A and 61B of the supporting unit 60 are activated to support the load of the table 6 and the lower mold 9. While this condition is underway, the first reciprocating unit 40A is driven to shift the first movable wedge 32, and the stationary wedge 31 is displaced upward by corresponding degrees to the shifted amounts of the movable wedge 32.

When the first movable wedge 32 is shifted by a predetermined distance, the displaced amounts at the positions X1~X7 agree with the sums of deflected amounts of the bed 1 and the ram 2 at the respective positions. Accordingly, the distance between the upper mold 8 and the lower mold 9 in the course of the bending process is kept constant along the length of the molds 8 and 9, thus properly correcting the curved deflection of the bed 1A and the ram 2. In consequence, the workpiece can be bent by a proper bending angle throughout the whole length.

Figure 16:
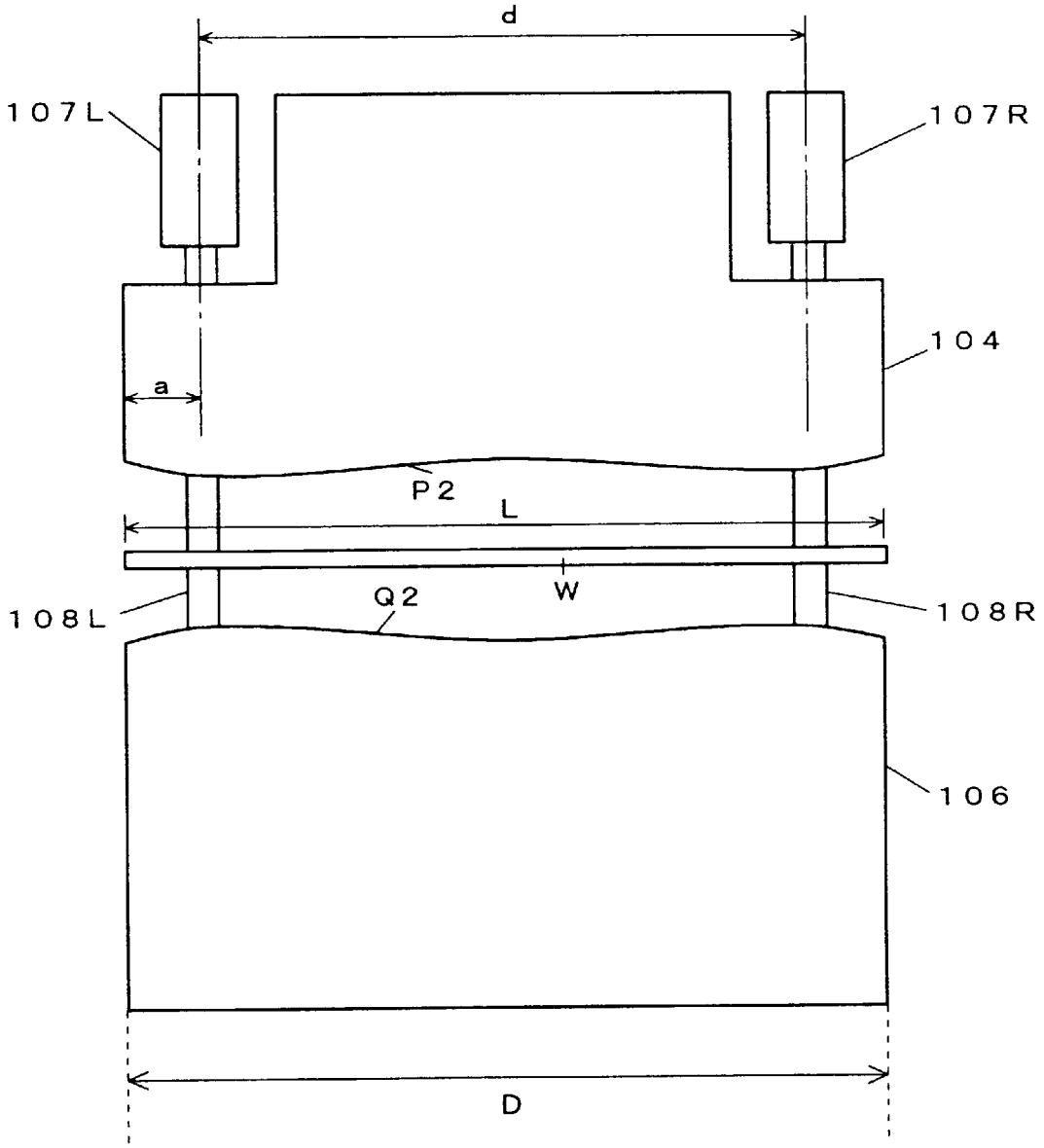
FIG. 16 is a view showing a deflected condition of a ram and a bed when bending a lengthy workpiece.

In such a case in which a length of a workpiece substantially coincides with the length of the device as being exemplified in FIG. 16, the second reciprocating unit 40B is driven to shift the second movable wedge 33 with the respective pairs of cylinder units 61A and 61B of the supporting unit 60 being operated to support the load of the table 6 and the lower mold 9. In consequence, the second movable wedge 33 is displaced upward by corresponding degrees to its own shifting amounts.

When the second movable wedge 33 is shifted by a predetermined distance, the displaced amounts at positions X1~X7 respectively coincide with the sums of deflected amounts of the bed 1 and the ram 2 at the respective positions. Accordingly, the distance between the upper mold 8 and the lower mold 9 in the course of the bending process can be kept constant along the length thereof, with the curved deflection of the bed 1 and the ram 2 being corrected. In consequence, the above workpiece can be bent by a proper bending angle throughout the whole length.

In such a case in which length of a workpiece is longer than that is shown in FIG. 15 and shorter than that is shown in FIG. 16, the first and second reciprocating units 40A and 40B are respectively driven to cause the first and second movable wedges 32 and 33 to be shifted with the respective pairs of cylinders 61A and 61B of the supporting unit 60 being operated to support the load of the table 6 and the lower mold 9.

As a result of the treatment, the stationary wedge 31 is displaced upward by amounts corresponding to the shifted amounts of the first movable wedge 32, and the second movable wedge 33 is displaced upward by amounts corresponding to its own shifting amounts. In consequence, the displaced amounts at positions X1~X7 correspond to the sums of the displaced amounts of the stationary wedge 32 and the second movable wedge 33 at respective positions respectively.

When the first and second movable wedges 32 and 33 have been shifted by predetermined distances respectively, the displaced amounts at positions X1~X7 coincide with the sums of deflected amounts of the bed 1 and the ram 2 at the respective positions. As a result, the distance between the upper mold 8 and the lower mold 9 in the course of the bending process can be kept constant along the length, with the curved deflection generated in the bed 1 and the ram 2 being corrected. In consequence, the above workpiece can be bent by a proper bending angle throughout the whole length.

The same treatment as in the above embodiment can also be achieved in the case of bending any workpiece by operating the press brake exemplified via the embodiments shown in FIGS. 8 and 10. Concretely, it is so adjusted that the amounts of displacement of the wedging unit 30A and 30B at the respective positions X1~X7 coincide with the respective sums of deflected amounts of the bed 1 and the ram 2 at the positions, by operating either or both of the first and second reciprocating units 40A and 40B in correspondence with the length of a workpiece. Accordingly, the distance between the upper mold 8 and the lower mold 9 during the bending process can be kept constant along the length of the molds, to correct the curved deflection generated in the bed 1 and the ram 2. In consequence, any of the workpieces can be bent by a proper bending angle throughout the whole length thereof.

What is claimed is:

1. A press brake for bending a workpiece between a lower mold and an upper mold, comprising:

a bed extending in a first direction for supporting said lower mold on an upper surface thereof;

a ram extending in said first direction for supporting said upper mold in opposition to said lower mold;

driving means for displacing one of said ram and said bed relative another one of said ram and said bed to in a pressing direction to press the workpiece between said upper mold and said lower mold;

distance adjusting means for adjusting a distance between said upper mold and said lower mold including a wedging unit disposed at one of a first position between said ram and said upper mold and a second position between said bed and said lower mold;

said wedging unit including first and second movable wedge members respectively having first and second movable engagement surfaces extending in said first direction and a stationary wedge member disposed between said first and second movable wedge members and having opposing first and second stationary engagement surfaces extending in said first direction and respectively in engagement with said first and second movable engagement surfaces to define respectively first engaged surfaces and second engaged surfaces;

said first engaged surfaces being comprised of a series of pairs of complementing inclined engaged surfaces serially disposed in said first direction and having differing angles of inclination relative to said first direction such that relative movement of said first engaged surfaces in said first direction effects relative displacement of said first movable wedge member with respect to said stationary wedge member in said pressing direction in displacement amounts that vary along said first direction to define a first deflection configuration;

said second engaged surfaces being comprised of a series of pairs of complementing inclined engaged surfaces serially disposed in said first direction and having differing angles of inclination relative to said first direction such that relative movement of said second engaged surfaces in said first direction effects relative displacement of said second movable wedge member with respect to said stationary wedge member in said pressing direction in displacement amounts that vary along said first direction to define a second deflection configuration; and said distance adjusting means further comprising first and second reciprocating units coupled to said first and second movable wedge members respectively to move said first and second movable wedge members along said first direction.

2. The press brake of claim 1, wherein said distance adjusting means further comprises supporting means for removing a load on said first and second movable wedge members during movement of said first and second movable wedge members.

3. The press brake of claim 1 wherein said first deflection configuration differs from said second deflection configuration.

4. The press brake of claim 1 wherein:

said first deflection configuration defines a substantially arc shaped configuration extending from a first end of said first deflection configuration to a second end of said first deflection configuration; and said second configuration defines an arc configuration in a center of said first configuration and depressions proximate ends of said second configuration.

5. The press brake of claim 1 wherein at least one of said first and second movable wedge members is comprised of interconnected wedges.

6. A press brake for bending a workpiece between a lower mold and an upper mold, comprising:

a bed extending in a first direction for supporting said lower mold on an upper surface thereof;

a ram extending in said first direction for supporting said upper mold in opposition to said lower mold;

driving means for displacing one of said ram and said bed relative another one of said ram and said bed to in a pressing direction to press the workpiece between said upper mold and said lower mold;

distance adjusting means for adjusting a distance between said upper mold and said lower mold including first and second wedging units disposed at one of a first position between said ram and said upper mold and a second position between said bed and said lower mold;

each of said first and second wedging units including a movable wedge member respectively having a movable engagement surface extending in said first direction and a stationary wedge member disposed adjacent said movable wedge member and having a stationary engagement surface extending in said first direction and in engagement with said movable engagement surface to define engaged surfaces;

said engaged surfaces of each of said first and second wedging units being comprised of a series of pairs of complementing inclined engaged surfaces serially disposed in said first direction and having differing angles of inclination relative to said first direction such that relative movement of said engaged surfaces in said first direction effects relative displacement of said movable wedge member with respect to said stationary wedge member in said pressing direction in displacement amounts that vary along said first direction to define a deflection configuration wherein said first wedging unit has a first deflection configuration and said second wedging unit has a second deflection configuration that are serially additive; and said distance adjusting means further comprising first and second reciprocating units coupled to said movable wedge members respectively of said first and second wedging units to move said movable wedge members along said first direction.

7. The press brake of claim 6, wherein said distance adjusting means further comprises supporting means for removing a load on said movable wedge members during movement of said movable wedge members.

8. The press brake of claim 6 wherein said first deflection configuration differs from said second deflection configuration.

9. The press brake of claim 6 wherein:

said first deflection configuration defines a substantially arc shaped configuration extending from a first end of said first deflection configuration to a second end of said first deflection configuration; and said second configuration defines an arc configuration in a center of said first configuration and depressions proximate ends of said second configuration.

10. The press brake of claim 6 wherein at least one of said stationary wedge member and said movable wedge member is comprised of interconnected wedges.

11. A press brake for bending a workpiece between a lower mold and an upper mold, comprising:

a bed extending in a first direction for supporting said lower mold on an upper surface thereof;

a ram extending in said first direction for supporting said upper mold in opposition to said lower mold;

driving means for displacing one of said ram and said bed relative another one of said ram and said bed to in a pressing direction to press the workpiece between said upper mold and said lower mold;

distance adjusting means for adjusting a distance between said upper mold and said lower mold including first and second wedging units disposed respectively at a first position between said ram and said upper mold and a second position between said bed and said lower mold;

each of said first and second wedging units including a movable wedge member respectively having a movable engagement surface extending in said first direction and a stationary wedge member disposed adjacent said movable wedge member and having a stationary engagement surface extending in said first direction and in engagement with said movable engagement surface to define engaged surfaces;

said engaged surfaces of each of said first and second wedging units being comprised of a series of pairs of complementing inclined engaged surfaces serially disposed in said first direction and having differing angles of inclination relative to said first direction such that relative movement of said engaged surfaces in said first direction effects relative displacement of said movable wedge member with respect to said stationary wedge member in said pressing direction in displacement amounts that vary along said first direction to define a deflection configuration wherein said first wedging unit has a first deflection configuration and said second wedging unit has a second deflection configuration; and said distance adjusting means further comprising first and second reciprocating units coupled to said movable wedge members respectively of said first and second wedging units to move said movable wedge members along said first direction.

12. The press brake of claim 11, wherein said distance adjusting means further comprises supporting means for removing a load on said movable wedge members during movement of said movable wedge members.

13. The press brake of claim 11 wherein said first deflection configuration differs from said second deflection configuration.

14. The press brake of claim 11 wherein:

said first deflection configuration defines a substantially arc shaped configuration extending from a first end of said first deflection configuration to a second end of said first deflection configuration; and said second configuration defines an arc configuration in a center of said first configuration and depressions proximate ends of said second configuration.

15. The press brake of claim 11 wherein at least one of said stationary wedge member and said movable wedge member is comprised of interconnected wedges.

* * * * *